US012612134B1

(12) United States Patent
Bray

(10) Patent No.: US 12,612,134 B1
(45) Date of Patent: Apr. 28, 2026

(54) DEPLOYABLE BARGE SYSTEM AND METHOD

(71) Applicant: Randy Bray, Sussex, NJ (US)

(72) Inventor: Randy Bray, Sussex, NJ (US)

( * ) Notice: Subject to any disclaimer, the term of this patent is extended or adjusted under 35 U.S.C. 154(b) by 3 days.

(21) Appl. No.: 19/307,931

(22) Filed: Aug. 22, 2025

(51) Int. Cl.
*B63B 3/48* (2006.01)
*B63B 7/00* (2020.01)
*B63B 27/16* (2006.01)

(52) U.S. Cl.
CPC ..... *B63B 3/48* (2013.01); *B63B 27/16* (2013.01); *B63B 2003/485* (2013.01); *B63B 2007/003* (2013.01)

(58) Field of Classification Search
CPC ..... B63B 3/48; B63B 27/16; B63B 2003/485; B63B 2007/003
See application file for complete search history.

(56) References Cited

U.S. PATENT DOCUMENTS 4,493,122 A * 1/1985 Echtler ..... E01D 15/127 14/2.4
5,117,525 A * 6/1992 Karcher ..... E01D 15/127 14/2.5
6,502,523 B1 * 1/2003 Robb ..... B63C 13/00 114/61.1
11,084,412 B1 * 8/2021 Shultz ..... H02S 10/10
2018/0099726 A1 4/2018 Broadway et al.

FOREIGN PATENT DOCUMENTS

| | | | |
|---|---|---|---|
| AU | 2020102191 | A4 | 10/2020 |
| CN | 106904250 | A | 6/2017 |
| CN | 107905086 | B | 8/2019 |
| CN | 110258483 | A | 9/2019 |
| KR | 102694672 | B1 | 8/2024 |
| WO | WO2018037277 | A1 | 3/2018 |
| WO | WO2024168604 | A1 | 8/2024 |

* cited by examiner

*Primary Examiner* — Stephen P Avila
(74) *Attorney, Agent, or Firm* — Intellectual Property Consulting, LLC; Stephen M. Kepper

(57) ABSTRACT

A floatable barge, deployment system, and method of use. The work barge and dump barge are operable to be directly loaded from the water and deployed into the water from a roll off truck. The barges include a top deck supported by a hull with a mounting assembly that is operable to engage a deployment mechanism of a roll off truck. Optionally, the work barge may include retractable pontoons that rotate from a folded position to an open position, and the dump barge may include a permeable barrier. Both barges are configured to be transported on roadways and interstate commerce via a roll off truck.

13 Claims, 7 Drawing Sheets

DEPLOYABLE BARGE SYSTEM AND METHOD

FIELD

The present application relates to the field of marine construction platforms. More specifically, the present invention relates to portable barges.

BACKGROUND

Conventional work barges are widely used in marine construction, dredging, offshore wind installation, and bridge maintenance. These platforms typically consist of fixed-hull vessels or pontoons that must be towed or transported in their assembled form to a job site. However, these fixed-hull barges require heavy equipment to offload the barge from a land transport vehicle into the water. The answer to some of these challenges led to the development of modular barges that can be transported in more manageable pieces and then assembled at the job site. While easier to transport and offload than the fixed hull barges, the assembly of these modular barges can be very time consuming and requires specialized labor.

Accordingly, there is a need in the art for an improved barge that is easily transportable, cost efficient, and less burdensome to deploy into water.

BRIEF SUMMARY OF THE INVENTION

It is the object of this invention to provide a system that includes a work barge capable of supporting earth excavating equipment and a dump barge that can be easily deployed into the water directly from a conventional roll-off truck or other similar deployment system. Both barges are operable to float in water and include a top deck supported by a hull. The bottom surface of the hull comprises a mounting assembly operable to engage a deployment mechanism on a roll off dumpster truck. The deployment mechanism allows the barge to be deployed directly into the water from the truck. Likewise, the barge can be retrieved directly from the water onto the truck through the engagement of the deployment mechanism to the mounting assembly. Optionally, the barge may include one or more retractable pontoons to provide additional flotation and surface area on the top deck. The dump barge may include a permeable barrier around the perimeter of the top deck that is operable to retain debris and materials while allowing water to pass through it.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
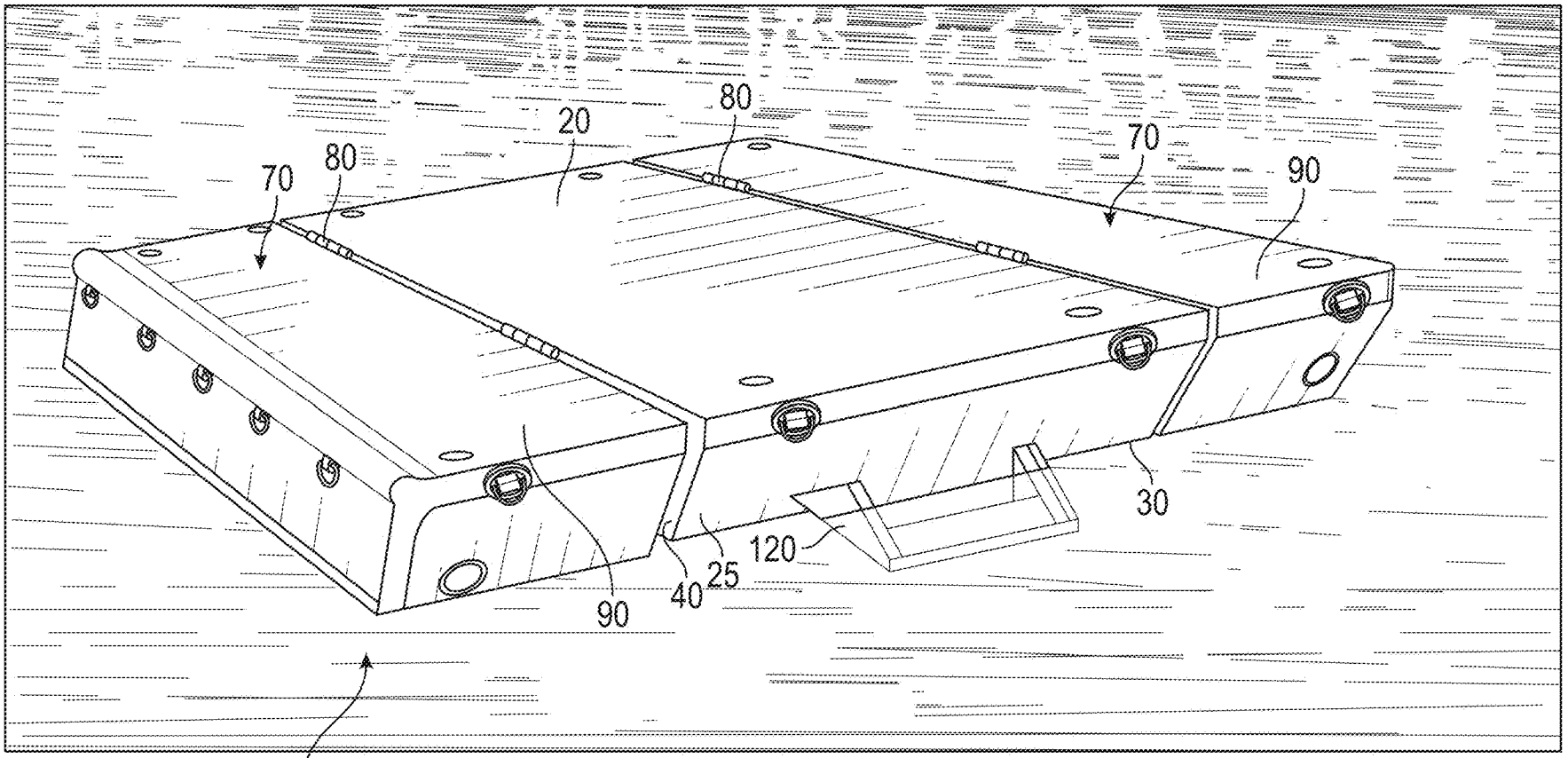
FIG. 1 depicts an isometric view of the work barge shown in an open configuration.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

Figure 5:
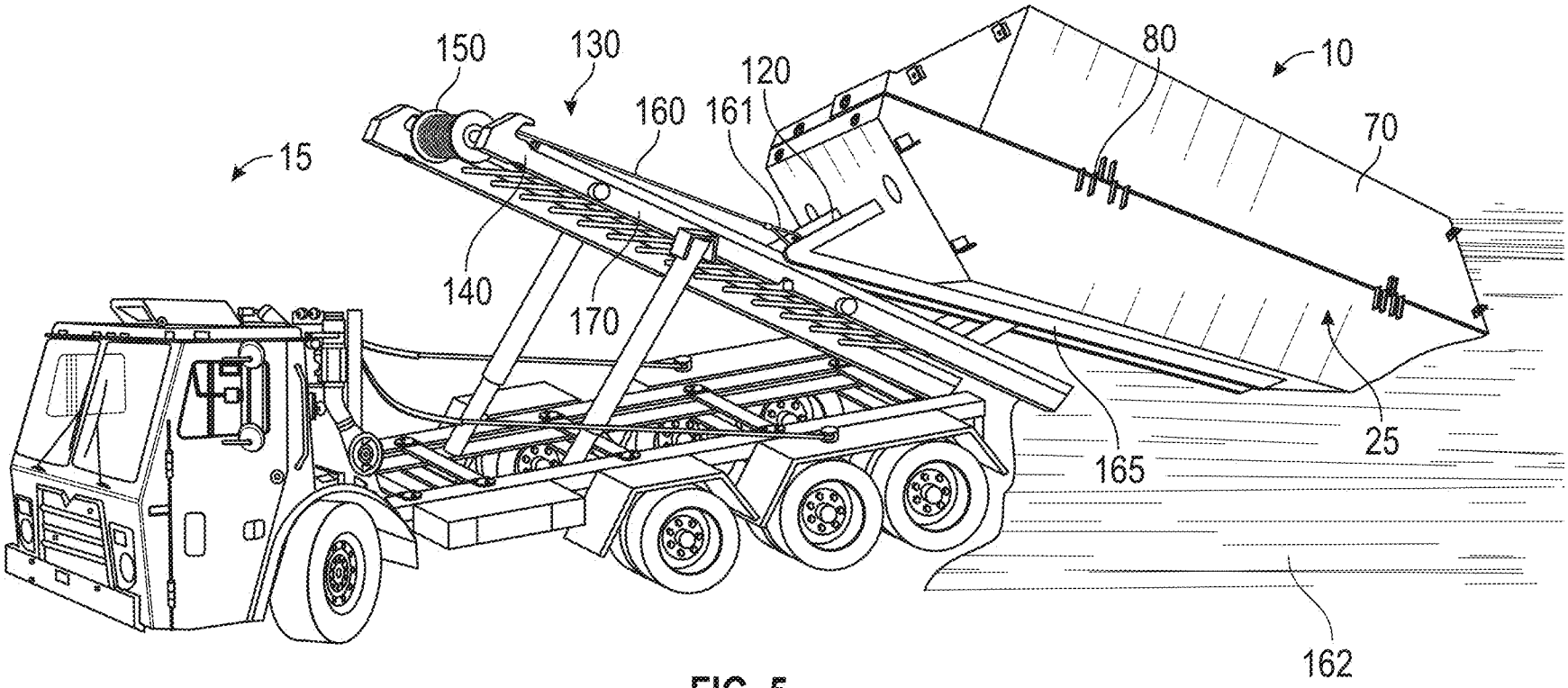
FIG. 5 depicts an isometric view of the roll-off truck deploying the work barge into water.

Turning to FIG. 1, an embodiment for the portable work barge 10 is shown that is configured to be loaded onto a roll-off dump truck 15 and deployed directly into the water (as detailed in FIG. 5).

The portable work barge 10 includes a top deck 20 supported by a hull 25. The hull 25 is defined by a bottom surface 30 and a surrounding wall 40 that extends to the top deck 20 and defines one or more enclosed spaces inside of the hull 25. In some embodiments, the top deck 20 and hull 25 may be a single, continuous body. In other embodiments, the top deck 20 may be installed separately on top of a prefabricated hull 25.

Figure 7:
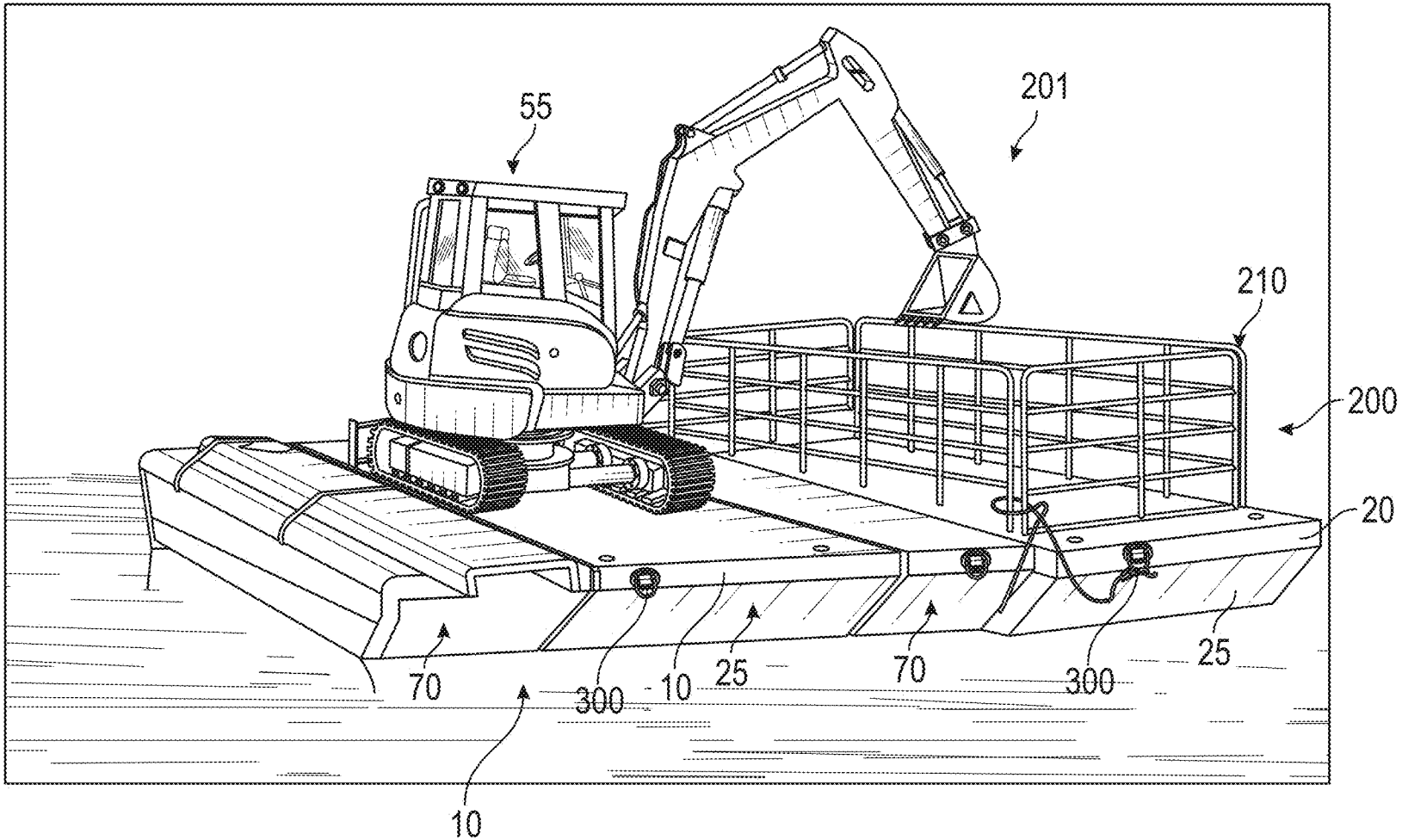
FIG. 7 depicts an isometric view of the system showing the work barge tethered to the dump barge.

In operation, the work barge 10 is operable to support an excavator 55 (or other earth excavating equipment) on its top deck (as detailed in FIG. 7). The hull 25 is configured to provide sufficient buoyancy such that the work barge 10 will float with an excavator or other earth excavating equipment on its top deck 20.

Figure 2:
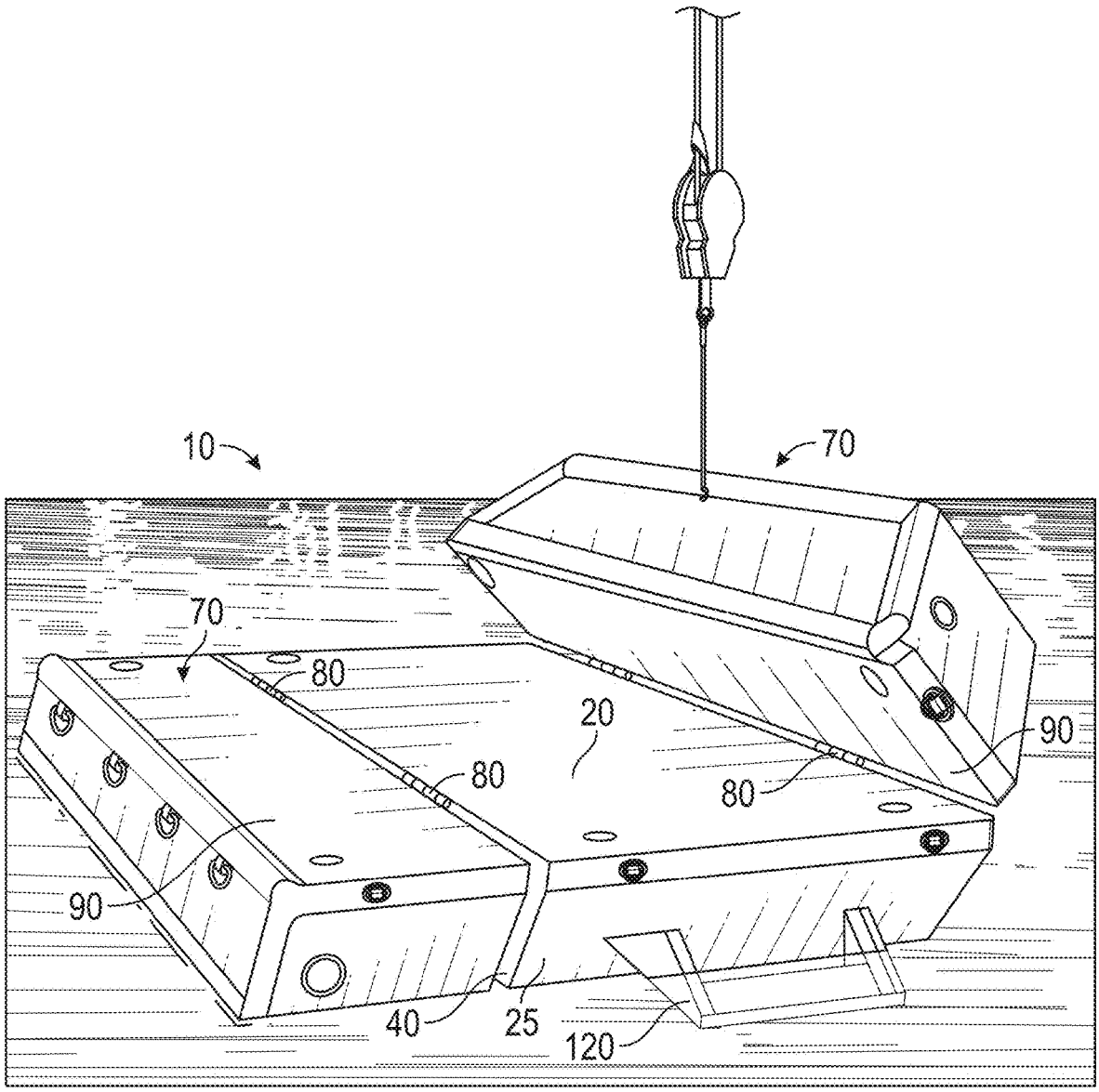
FIG. 2 depicts an isometric view of the work barge shown in a partially folded configuration.
Figure 3:
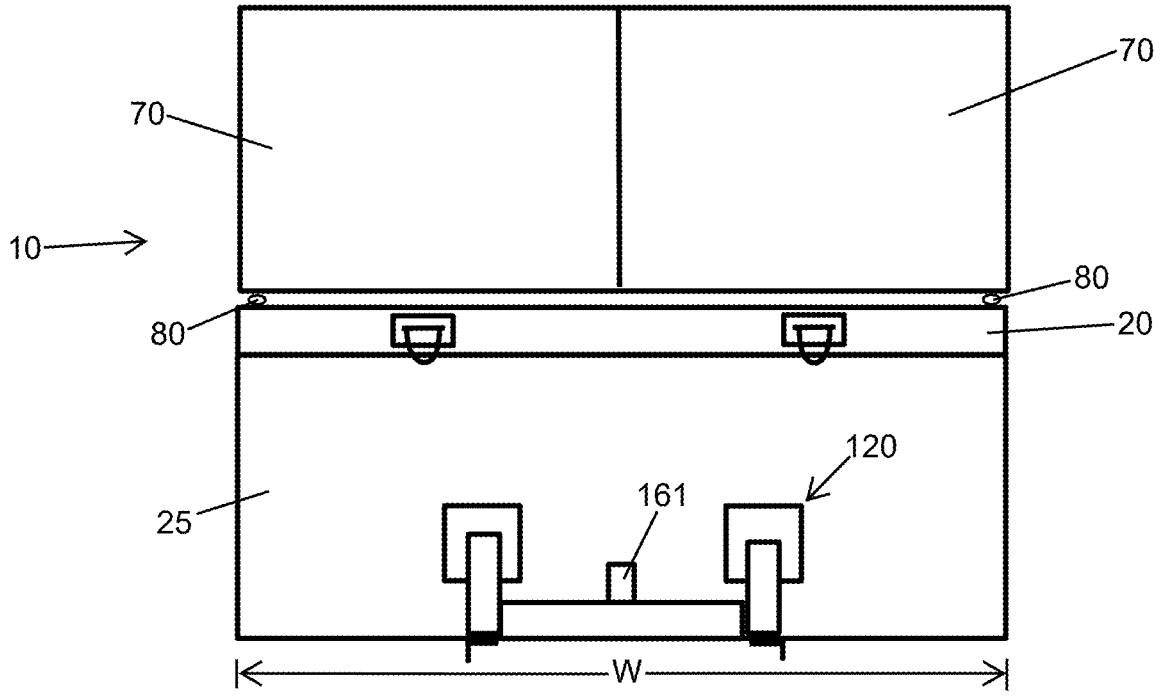
FIG. 3 depicts a front view of the work barge shown in a folded configuration.

As an optional feature, the work barge 10 may include pontoons 70 on either side of the work barge 10. As shown in FIGS. 1-2, the pontoons 70 may be hingedly coupled to the work barge 10 such that the pontoons are fully retractable. FIG. 1 shows the pontoons 70 fully extended in an open position. FIG. 2 shows one of the pontoons 70 being unfolded in partially open position. FIG. 3 shows the pontoons 70 folded onto the top deck 20 in a closed position. Any type of hinge 80 or other fastener capable of allowing the pontoon 70 to rotate from the closed position to the open position may be utilized.

As shown in FIG. 1, when in an open position, the top surface 90 of the pontoon 70 is substantially coplanar with the top deck 20 to allow for an increased work area on the work barge 10. In addition to providing a larger work surface area on the work barge 10, the additional pontoons 70 provide additional buoyancy to support additional equipment on the top deck 20.

The work barge 10 is specifically designed to be transportable on roadways and in interstate commerce. As shown in FIG. 3, when in the closed position, the top surface 90 of the pontoons 70 rest and face the top deck 20 such that the entire width W of the work barge 10 is equal to or less than the maximum allowable width for commercial motor vehicles as set forth by the Federal Highway Administration or other governing agency. For example, in one embodiment the width W is approximately eight (8) feet. In alternative embodiments, the width W can be up to 102 inches.

As shown in FIG. 5, the work barge 10 is operable to be loaded onto a roll-off truck 15 using a mounting assembly 120. The mounting assembly 120 on the barge 10 operatively engages a deployment system 130 on the roll-off truck 15 that is designed to load and unload the work barge 10 from the truck 15.

The deployment system 130 could be a cable hoist system that includes a truck-mounted hydraulic hoist 150 (e.g. a winch) with cables 160 and a latch 161 that attach to the work barge 10. The hydraulic hoist is operable to pull the work barge 10 onto the chassis 140 of the truck 15 in the same manner that it is used to unload the work barge 10 off the chassis 140 directly into the water 162 (as shown in FIG. 5). To guide the work barge 10 onto the chassis 140, the mounting assembly 120 includes a latch 161 configured to receive a hook at the end of the cable 160, and one or more rails 165 configured to slidably engage one or more corresponding guide slots 170 disposed on the chassis 140 of the roll off truck 15.

Another example of a deployment system 130 is a hook-lift system used in the art for loading and unloading trash dumpsters. The hook lift system utilizes a hydraulic arm that is operable to lift the work barge 10 at an angle and the hydraulic arm articulates back towards the truck to load the work barge 10 onto the chassis 140 of the truck 15. The hydraulic arm functions in a reversible sequence when deploying the work barge 10 into the water.

In operation, and as depicted in FIG. 7, the work barge 10 works in tandem with one or more dump barges 200 as part of the roll off system 201 to allow the earth excavating equipment 55 on the work barge 10 to pick up and load debris or other materials onto the dump barge 200.

Figure 4:
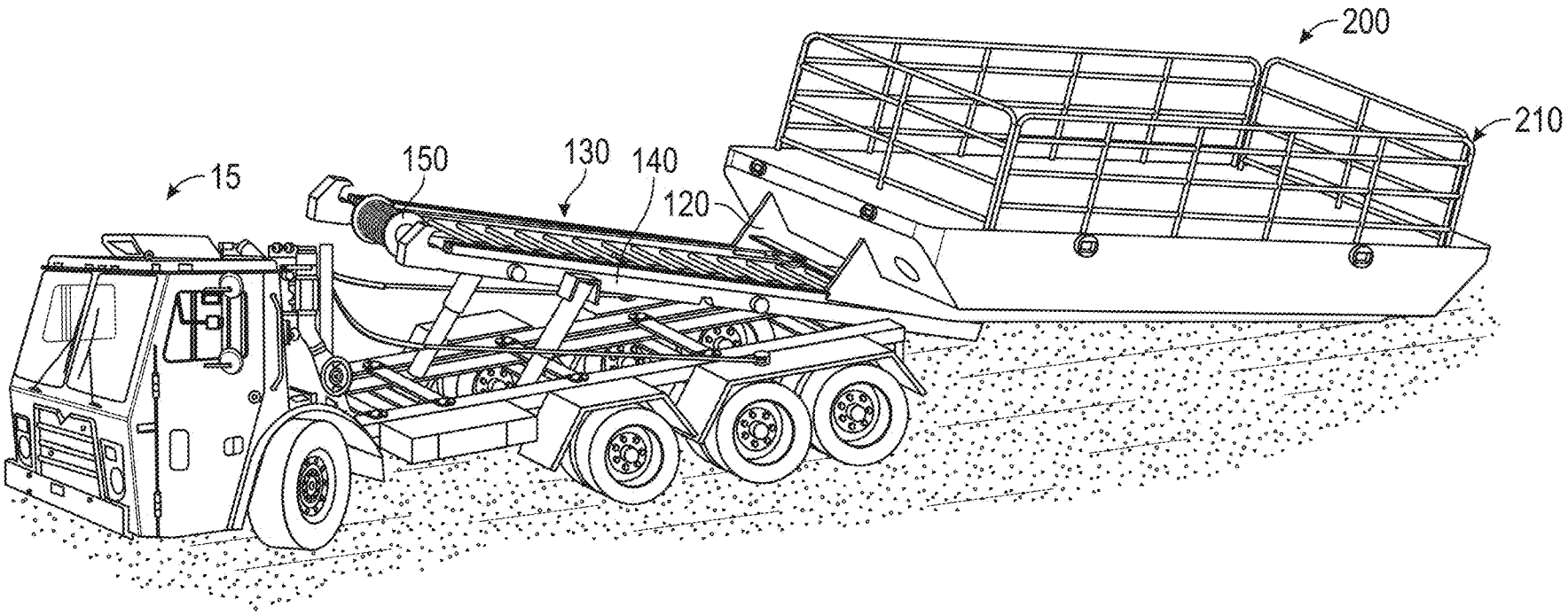
FIG. 4 depicts an isometric view of a roll-off truck loading the dump barge from land.

The dump barge 200 can be constructed in accordance with any of the aforementioned embodiments for the work barge 10. Like the work barge, the hull 25 for the dump barge 200 is customizable and scalable such that it is operable to provide adequate buoyancy to support the dump barge 200 as well as any corresponding loads created by debris or materials loaded onto the dump barge 200 while in flotation. Furthermore, as detailed in FIG. 4, the dump barge 200 is equipped with a mounting assembly 120 in accordance with any of the foregoing embodiments, which allows the dump barge 200 to enjoy the same functionality of being directly loaded onto a roll-off truck 15 from the water and directly deployed into the water from the truck 15.

Figure 6:
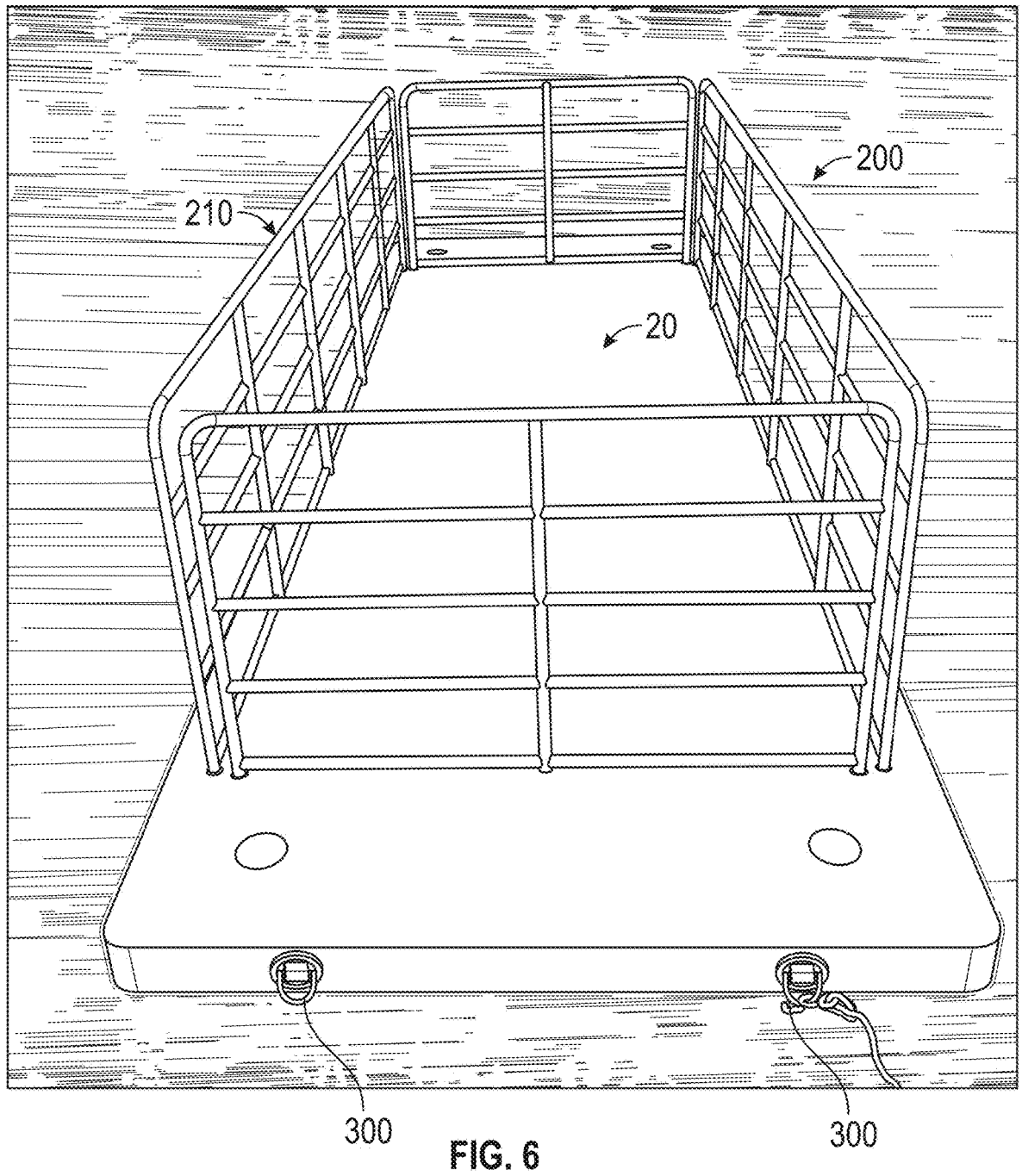
FIG. 6 depicts an isometric view of the dump barge.

In the preferred embodiment, and as shown in FIG. 6, the dump barge 200 includes a permeable barrier 210 that is operable to retain debris on the top deck 20 but allow water to freely flow through it. As examples, the permeable barrier 210 may include a railing around the perimeter of the top deck 20 as shown in FIG. 6. Alternatively, depending on materials to be loaded onto the dump barge 200, a different type of permeable barrier 210 may be utilized, including but not limited to, grating, perforated sheets, or steel plate. For example, the perforated sheets would be utilized for wood waste, plastic, and trash. The grating would be utilized for larger objects like demolition of an existing dock. The steel plate would be preferable for sludge or dredge material.

Both the work barge 10 and dump barge 200 may be equipped with one or more cleats 300 that can be used to anchor the barges to each other or to another vessel (e.g. a tugboat) or land during use.

The invention is not limited to the illustrative embodiments and encompasses variations and alterations of these embodiments. Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims. For example, the deployment mechanisms and mounting assemblies used for conventional roll off trucks and garbage dumpsters are intended to be used for the disclosed barge embodiments. For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A portable work barge system comprising:

a roll off truck comprising a deployment mechanism, and a portable work barge operable to float in water comprising a top deck supported by a hull, wherein a bottom surface of the hull comprises a mounting assembly operable to engage the deployment mechanism on the roll off truck, wherein the roll off truck is operable to lower the portable work barge directly into the water and is operable to retrieve the portable work barge directly from the water, wherein the deployment system comprises a hydraulic hoist system or a hooklift system, and wherein the deployment system comprises one or more guide slots and wherein the mounting assembly comprises one or more rails, wherein the one or more rails are configured to slidably engage the one or more corresponding guide slots.

2. The portable work barge system of claim 1, wherein the hull comprises one or more enclosed spaces.

3. The portable work barge system of claim 2, comprising one or more retractable pontoons, each of the one or more retractable pontoons being hingedly coupled to a side of the portable work barge.

4. The portable work barge system of claim 3, wherein each of the one or more retractable pontoons comprises a top surface and is configured to rotate between an open position and a folded position, wherein in the open position, the top surface of each of the one or more retractable pontoons is substantially coplanar with the top deck, and wherein, in the folded position, the top surface of the one or more retractable pontoons faces the top of the top deck and defines a width of the portable work barge.

5. The portable work barge system of claim 3 further comprising a dump barge, wherein the roll off truck is operable to deploy the dump barge directly into the water and retrieve the dump barge directly from the water, wherein the dump barge comprises a permeable barrier operable to retain debris and materials while allowing water to flow through it.

6. The portable work barge system of claim 5 wherein the dump barge is removably coupled to the portable work barge.

7. The portable work barge system of claim 4 wherein the width of the portable work barge in the folded position does not exceed 102 inches.

8. A portable work barge system comprising:

a roll off truck comprising a deployment mechanism, a portable work barge operable to float in water comprising one or more retractable pontoons, each of the one or more retractable pontoons being hingedly coupled to a side of the portable work barge, and a top deck supported by a hull, wherein a bottom surface of the hull comprises a mounting assembly operable to engage the deployment mechanism on the roll off truck, wherein the roll off truck is operable to lower the portable work barge directly into the water and is operable to retrieve the portable work barge directly from the water, wherein the hull comprises one or more enclosed spaces, and a dump barge, wherein the roll off truck is operable to deploy the dump barge directly into the water and retrieve the dump barge directly from the water, wherein the dump barge comprises a permeable barrier operable to retain debris and materials while allowing water to flow through it.

9. The portable work barge system of claim 8 wherein the dump barge is removably coupled to the portable work barge.

10. The portable work barge system of claim 8, wherein each of the one or more retractable pontoons comprises a top surface and is configured to rotate between an open position and a folded position, wherein in the open position, the top surface of each of the one or more retractable pontoons is substantially coplanar with the top deck, and wherein, in the folded position, the top surface of the one or more retractable pontoons faces the top of the top deck and defines a width of the portable work barge.

11. The portable work barge system of claim 10 wherein the width of the portable work barge in the folded position does not exceed 102 inches.

12. The portable work barge system of claim 9, wherein the deployment system comprises a hydraulic hoist system or a hooklift system.

13. The portable work barge system of claim 9, wherein the deployment system comprises one or more guide slots and wherein the mounting assembly comprises one or more rails, wherein the one or more rails are configured to slidably engage the one or more corresponding guide slots.

* * * * *